US006006461A

United States Patent [19]

Snyder

[11] Patent Number: 6,006,461

[45] Date of Patent: Dec. 28, 1999

[54] TURBULENCE FLUID DISPLAY

[76] Inventor: Robert D. Snyder, 1010 Donnalee, Monroe, Mich. 48161

[21] Appl. No.: 08/442,525

[22] Filed: May 16, 1995

[51] Int. Cl.[6] ..... G09F 19/12

[52] U.S. Cl. ..... 40/426; 40/406

[58] Field of Search ..... 446/136, 219; 40/406, 426, 414

[56] References Cited

U.S. PATENT DOCUMENTS

| | | | |
|---|---|---|---|
| 2,282,430 | 5/1942 | Smith | 40/426 |
| 2,770,073 | 11/1956 | Sullivan | 40/426 |
| 3,874,102 | 4/1975 | Sheppard | 40/426 |
| 4,177,592 | 12/1979 | Ruck | 446/136 X |
| 4,490,931 | 1/1985 | Fleemin | 40/406 |
| 4,949,485 | 8/1990 | Garrett | 40/406 |
| 5,050,876 | 9/1991 | Chuang | 40/426 X |
| 5,052,714 | 10/1991 | Muscat et al. | 40/414 X |
| 5,146,701 | 9/1992 | Lee | 40/406 |
| 5,156,550 | 10/1992 | Alexander . | |
| 5,189,821 | 3/1993 | Lee | 40/406 |
| 5,272,604 | 12/1993 | Lin . | |
| 5,301,444 | 4/1994 | Horiuchi | 40/426 |
| 5,435,086 | 7/1995 | Huang | 40/426 |

*Primary Examiner*—Joanne Silbermann
*Attorney, Agent, or Firm*—Young & Basile, PC

[57] ABSTRACT

At least one liquid exhibiting variable visual effects is disposed in a transparent chamber and is moved in variable, turbulent flow patterns by a magnetic member freely movably disposed on the bottom of the chamber. A magnet is mounted on a rotatable output shaft of a drive motor disposed adjacent to the bottom of the chamber and is magnetically coupled to the movable member to move the movable member in a chaotic, variable pattern to generate variable liquid flow within the chamber. The speed of rotation and the direction of rotation of the motor output shaft at a selected speed are variably selectible.

15 Claims, 2 Drawing Sheets

TURBULENCE FLUID DISPLAY

BACKGROUND OF THE INVENTION

1. Field of the Invention

The present invention relates, in general, to fluid or liquid display devices.

2. Description of the Art

Liquid display devices have been devised which contain a flowable, continually moving liquid which creates a pleasing or aesthetic visual flow pattern.

One such liquid display device is a so-called oscillating wave cell. In this type of display device, a hollow chamber is mounted on a base and rocks by means of a drive mechanism in an oscillating manner. The chamber contains one and usually two immiscible liquids which create waves within the chamber and/or variable flow patterns within the immiscible liquids.

U.S. Pat. No. 5,189,821 discloses another type of liquid display device in which two immiscible liquids, such as water and oil, are disposed within a transparent chamber. A motor containing two rotatable output shafts is mounted in a separate chamber below the liquid filled chamber. A horn shaped diaphragm having magnets at lower, outer end portions is mounted within the liquid chamber. Rotation of the motor output shafts causes magnets mounted on the motor output shafts to alternately attract and repulse the magnets on the diaphragm thereby causing the diaphragm to reciprocate up and down about a central fixed post. This reciprocal movement of the diaphragm creates waves in the liquids in the chamber.

U.S. Pat. No. 5,301,444 discloses a similar liquid display device in which a pair of rotating magnets mounted in a closed chamber behind a liquid filled chamber interact with a magnetic animated marine figure, such as a toy fish, in the liquid filled chamber to cause movement of the fish in all directions to simulate the swimming action of a natural fish.

U.S. Pat. No. 5,272,604 discloses a cyclonic liquid display ornament in which two or more liquids having different specific gravities are disposed in a first chamber. A centrifugal impeller is mounted at the bottom portion of the first chamber and interacts with a magnetic element mounted on the output shaft of a motor disposed in a separate chamber immediately below the first chamber. Rotation of the motor output shaft causes corresponding rotation of the impeller which creates a vortex within the liquid of lesser specific gravity to create a cyclone within the first chamber.

While the above-described prior art liquid display devices provide interesting and pleasing visual patterns within the liquid, it would be desirable to provide a liquid display device which is capable of more varied patterns to create a more pleasing or interesting visual effect. Thus, contrary from the prior art liquid display devices described above, it would be desirable to provide a liquid display device in which the direction of rotation of a drive motor output shaft is varied according to a preset program or sequence to cause variable movement of a magnetic member disposed within the liquid filled chamber to thereby vary the liquid flow patterns within the liquid filled chamber. It would also be desirable to provide such a liquid display device in which the movable member disposed within the liquid chamber is capable of more varied or random movement under magnetic interaction with a rotating drive motor output shaft.

SUMMARY OF THE INVENTION

The present invention is a turbulence fluid display device which generates a pleasing, continually changing visual fluid pattern.

The display device includes a transparent chamber having a bottom and side walls. At least one and, preferably, two or more non-immiscible liquids are disposed in the chamber. A magnetic movable member is also disposed in the chamber and is freely movable over the bottom of the chamber. In a preferred embodiment, the movable member has an eccentric shape, such as an oval or egg shape. A rotatable magnet means is mounted externally of the liquid filled chamber, preferably below the bottom of the chamber, for moving the movable member in a varying pattern about the bottom of the chamber to create turbulent flow of the liquids within the chamber.

The rotatable magnet means preferably comprises an electric motor having a rotatable output shaft, with a magnet mounted thereon. The output shaft of the motor is preferably mounted eccentric from a longitudinal axis of the liquid filled chamber.

Control means are provided for bi-directionally rotating the output shaft of the motor which, in a preferred embodiment is a stepper-type motor. The control means preferably includes means for reversing the phase sequence applied to the motor to bi-directionally change the direction of rotation of the motor output shaft. In addition, the control means includes means for selecting the frequency at which a multivibrator pulses the phase sequencer which in turn varies the speed of the motor. The frequency selecting means may include a timer so as to apply a particular frequency to the phase sequencer to thereby generate a particular motor output shaft rotational speed for a predetermined time before a different frequency is applied to the motor to change the motor output shaft rotational speed.

The timer may be provided with user selectible time periods by means of a user activated switch mounted exteriorly on the chamber. A separate switch may also be provided for manually selecting the frequency applied to the motor controller to thereby vary the speed of rotation of the motor output shaft under user control.

In a preferred embodiment, the liquid filled chamber is provided with an angularly disposed viewing surface or facia which is formed in a portion of the side wall of the chamber and offset at a predetermined angle from the longitudinal axis or center line of the chamber. In a preferred example of the present invention, the facia is formed at an upper end of the chamber and has a generally oval shape. The facia may comprise a separate, transparent plate which is sealingly secured to the upper ends of the side wall of the liquid chamber. The facia may be disposed at any predetermined angle, with angles of 30° to 60° being preferred.

The turbulence fluid display device of the present invention provides more interesting and pleasing liquid flow patterns than possible with previously devised liquid display devices. The angled facia provides a deflecting surface for the liquid which thereby provides optimal observation of the vortices and chaotic flow patterns within the liquid as the liquid deflects off of the facia.

More chaotic or variable liquid flow patterns are created by the present liquid display device due to the mounting of the output shaft of the motor offset from the longitudinal axis or center line of the chamber and providing the movable member in a freely movable shape within the liquid filled chamber. Also, the movable member has an eccentric or egg-shape to introduce additional variability in the liquid flow patterns.

The motor control is provided with bi-directional selection of the direction of rotation of the motor output shaft as well as variably selectible motor output shaft rotational speeds. A timer with variable selectible periods is also employed to control the switching of the motor speed and the direction of motor output shaft rotation.

The end result is a turbulence fluid display device which creates continually varying, visual fluid flow patterns.

BRIEF DESCRIPTION OF THE DRAWING

The various features and advantages of the present invention will become more apparent by referring to the following detailed description and drawing in which.

DESCRIPTION OF THE PREFERRED EMBODIMENTS

Figure 2:
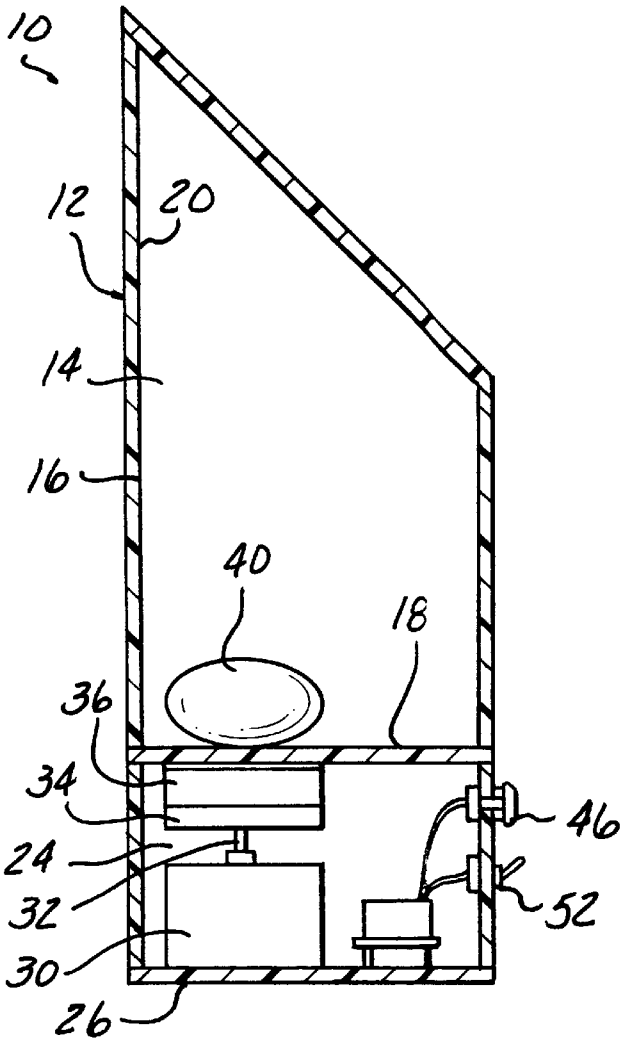
FIG. 2 is a partially cross sectioned, front elevational view of the display device shown in FIG. 1.
Figure 1:
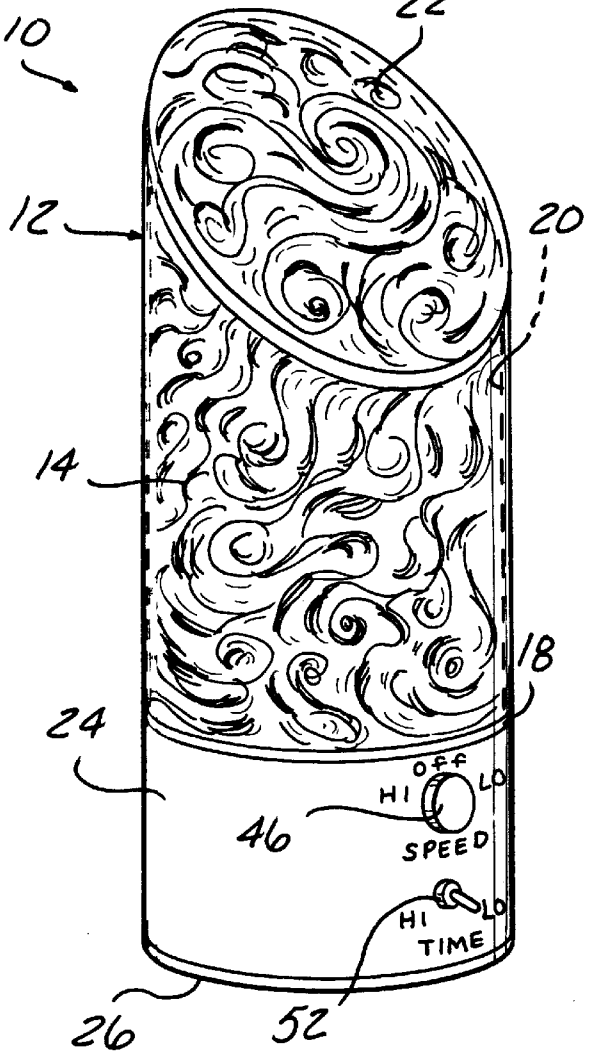
FIG. 1 is a perspective view of a turbulence fluid display device constructed in accordance with the teachings of the present invention.

Referring now to the drawing, and to FIGS. 1 and 2 in particular, there is depicted a turbulence fluid or liquid flow display device 10 which is designed to create variable, pleasing and aesthetic visual fluid flow patterns.

The display device 10 is in the form of a housing 12. The housing 12 includes a first fluid or liquid chamber 14 which, by way of example only, has a hollow, generally cylindrical shape formed of a cylindrical side wall 16 and a bottom wall 18. It will be understood that the side wall 16 may take different shapes, other than the generally cylindrical, circular cross section shape shown in FIGS. 1 and 2.

According to a preferred embodiment of the present invention, the upper end of the side wall 16 terminates in an edge 20 which supports a viewing surface or facia 22. The facia 22 is disposed at a predetermined angle from the longitudinal axis or center line of the chamber 14. Although any angle between approximately 30° and 60° may be employed, preferably the facia 22 is disposed at an angle of about 37.5° to about 45° from the longitudinal axis of the chamber 14. This provides an ideal viewing surface for visually observing the vortices and flow patterns of the liquid within the chamber 14 as described hereafter. In addition, the angled disposition of the facia 22 acts to deflect the liquid flow within the chamber 14 to create additional variability and interesting flow patterns.

The chamber 14 and the facia 22 may be formed of a suitable, transparent material, such as an acrylic plastic. Further, the side wall 16 and bottom wall 18 which form the chamber 14 may be integrally formed as a unitary, one-piece member or as two separate members which are joined together by means of suitable fasteners, adhesive, etc.

The housing 12 also includes a separate chamber 24 which is preferably, but not necessarily, disposed below the bottom wall 18 of the liquid chamber 14. The second chamber 24 preferably has the same exterior shape as the chamber 14, such as the generally cylindrical shape shown in FIGS. 1 and 2. The side walls of the second chamber 24 are joined to the bottom wall 18 of the chamber 14 by suitable fasteners, adhesive, etc. A base 26 is formed at one end of the chamber 24 for supporting the entire housing 12 on a support surface.

A fluid fills all or substantially all of the chamber 14. The selected fluid may be any fluid which is capable of generating distinguishable patterns during flow. In one example, the fluid is formed of 30 ounces of a liquid soap sold under the trademark "SOFT SOAP". This liquid soap includes glycol stearate which provides pearlescence characteristics 45 drops of Winsor Newton Royal Blue water color are added to the liquid soap along with water to fill the chamber 14.

Alternately, a plurality of liquids, such as two or more, may be disposed in the chamber 14. Such liquids are preferably non-homogeneous or non-immiscible and may have different specific gravities so as to move in different flow paths.

The display device 10 includes means for generating chaotic or variable flow patterns within the liquid or liquids contained within the chamber 14. Such means preferably includes a drive motor 30 mounted within the chamber 24. The motor 30 has a rotatable output shaft 32 extending outward from one side. A plate 34 is mounted on one end of the output shaft 32 and supports a magnet 36 having opposed ends with opposite magnetic polarity. As shown in FIG. 2, the magnet 36 is disposed in close proximity to the bottom wall 18 of the liquid filled chamber 14; but is mounted in the chamber 26 so as to be separate from the liquid in the chamber 14.

Preferably, the output shaft 32 of the motor 30 is offset from the longitudinal axis or center line of the housing 12 to cause additional chaotic movement of the movable member 40 and thereby introduce variability into the flow patterns of the liquid contained within the chamber 14.

The motor 30 may be connected to a suitable source of electric power. The power source may comprise d.c. batteries, not shown, mounted within the chamber 24 and connected to the control means or circuit described hereafter and shown in FIG. 3. Alternately, the motor 30 may be connected via an external plug to a conventional electrical outlet to supply 110 volt a.c. power to the motor 30. In the case of a.c. power, a suitable transformer and d.c. rectifier are employed to provide the necessary low voltage d.c. power to the control circuitry described hereafter.

Figure 3:
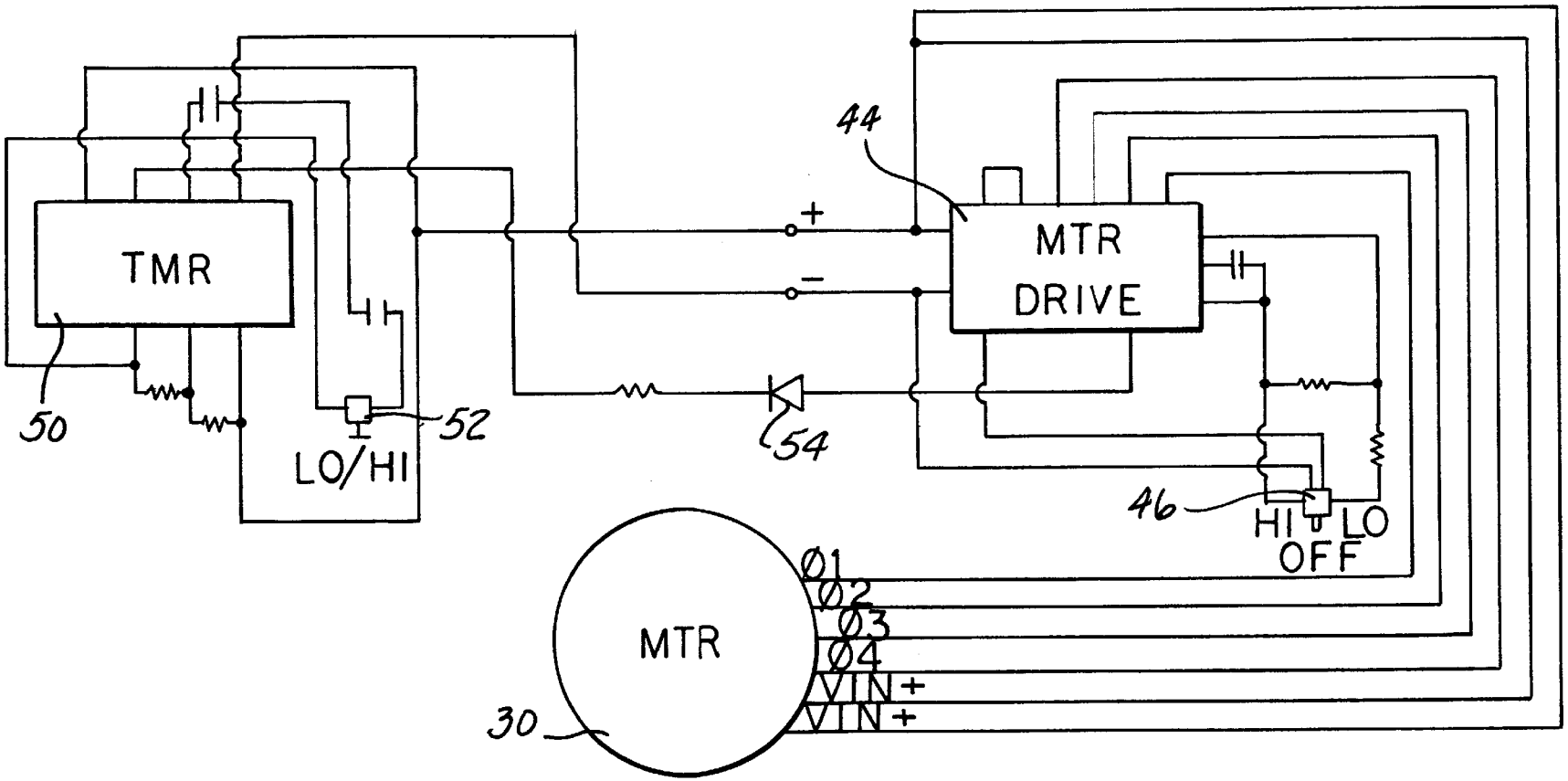
FIG. 3 is a schematic diagram of the control circuit employed in the display device of the present invention.

The motor 30 is preferably a stepper type motor, such as a stepping motor sold by Hurst, model number PAS-3205-001. The motor 30 has an output shaft 32 connected to the rotor or the motor 30 which rotates by electronic communication of the motor stator windings. As shown in FIG. 3, a stepper motor drive 44, such as one sold by Hurst, model number 220006, controls the speed and direction or rotation of the output shaft of the motor 30 in a conventional manner as described hereafter. The step rate or speed of rotation of the rotor is controlled by an internal multivibrator which has an externally connected resistor and capacitor connected thereto to set the frequence of pulses from the multivibrator to the motor phase sequencer.

A movable member 40 is freely movably mounted within the chamber 14 and preferably is disposed on the bottom wall 18 of the chamber 14. The movable member 40 is formed of a magnetic material, such as iron, and may optionally be coated with a low friction material, such as TEFLON. Further, the movable member 40 preferably has an eccentric shape, such as a generally oval or egg shaped as shown in FIG. 2. This introduces additional randomness or variability to the movement of the member 40 about the bottom wall 18 of the chamber 14 via magnetic coupling with the magnet 36 rotatably driven by the motor 30.

According to a unique aspect of the present invention, means are provided for varying the speed of rotation of the motor output shaft 32. The speed varying means includes a user manipulated selector switch 46 which is mounted on the side wall of the housing 12 forming the lower chamber 24. The switch 46, by way of example only, is a double pole, three position switch having a center off position and two oppositely disposed positions corresponding to "HI" and "LO" motor speeds. The outputs of the switch 46 are connected to the motor drive circuit 44 which, depending upon the position of the switch 46, selects different frequencies at which the multivibrator stops the motor 30 to drive the output shaft 32 of the motor 30 between an off state and one of two speeds, such as a high speed of 160 rpm, for example, and a "lo" speed of 120 rpm.

Means are also provided for varying the direction of rotation of the motor output shaft 32. The rotation direction varying means includes a timer 50, shown in FIG. 3, which is connected to appropriate inputs on the motor drive circuit 44. The timer 50, which may comprise a conventional 555 integrated circuit, provides at least one time period or output signal which is input to the clockwise/counterclockwise select input of the motor drive circuit 44 and used to reverse the direction of rotation of the motor output shaft 32 by providing appropriate signals to the motor drive circuit 44 at the expiration of each single time period. A diode 54 is connected between the output of the timer 50 and the above-described input of the motor drive circuit 44 to provide a single polarity signal to the motor drive circuit 44.

Further variability may be provided by utilizing a second user manipulated switch 52 which is mounted on the exterior surface of the lower chamber 24. Preferably, the switch 52 is a two position switch, the outputs of which are connected to the timer 50 and used to vary the length of the time period before the timer 50 provides the output signal indicating the expiration of the time period. Thus, by way of example only, the switch 52 has two positions corresponding to a "lo" time and a "hi" time. The "hi" time period may be 70 seconds, by way of example, and the "lo" time may be 35 seconds. The user can select the appropriate time period by moving the switch 52 to the desired position. The timer 50 then continuously generates consecutive time periods of the selected time duration and provides an output signal at the completion of each time period to the motor drive circuit 44. This signal is used by the motor drive circuit 44 to reverse the phase sequence applied to the motor phase leads of the motor 30 to thereby change the direction of rotation of the motor output shaft 32.

Although variation of the speed of the motor 30 and the direction of rotation of the motor output shaft 32 have been described as being under user control via the switches 46 and 52, such speed and rotation direction can be varied automatically by means of additional circuitry, such as one or more timers and control circuits, which switch the timer output signal between different timers having different present time periods, as well as changing the motor speed at the end of each time period. A microprocessor having a control program stored in a memory may also be employed to provide different time periods and different motor speed signals according to a predefined program sequence.

In use, from an off position of the switch 46, the user may select the desired motor output shaft rotational speed by moving the switch 46 to either the "hi" or "lo" position. The motor drive circuit 44 supplies the appropriate phase sequence control to the motor 30 which then rotates the output shaft 32 in one direction at the selected "hi" or "lo" speed. This causes rotation of the magnet 36 mounted on the end of the motor output shaft 32 and causes alternating attraction and repulsion of the movable member 40 by the opposite polarity ends of the magnet 36 during rotation of the magnet 36. Due to the offset mounting position of the magnet 36 from the longitudinal axis of the housing 12 and the eccentric shape of the movable member 40, the movable member 40 moves freely on the bottom wall 18 of the liquid fill chamber 14 in an erratic or wobbling pattern due to its eccentric shape. This causes variable flow patterns to be introduced into the liquid(s) within the chamber 14. Such patterns generate multiple vortices and chaotic flow within the chamber 14. Further, when two or more non-homogeneous liquids having different specific gravities are disposed in the chamber 14, each liquid undergoes different flow thereby creating even more variability to the visualized flow patterns. In addition, the liquid deflects off of the angled facia 22 to further change the visualized flow patterns which can be easily observed through the facia 22.

At the completion of the time period selected by the switch 52, the timer 50 generates an output signal to the motor drive circuit 44 which, in turn, reverses the phase switching sequence applied to the motor 30 resulting in a reversal of the direction of rotation of the motor output shaft 32. This immediately alters the flow patterns of the liquid within the chamber 14. It should be noted that the user may switch the time switch 52 to the opposite state, such as from "lo" to "hi", at any time to provide a different length of time between a change in the direction of rotation of the motor output shaft 32.

Figure 4:
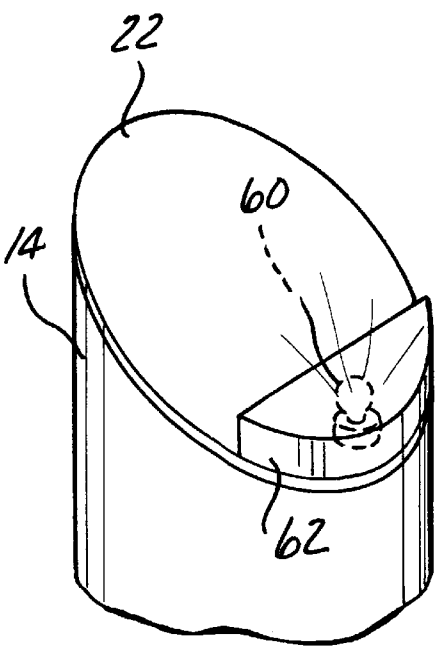
FIG. 4 is a partial, perspective view of an alternate embodiment of the fluid display device.

An alternate embodiment of the fluid display device 10 is shown in FIG. 4. In this embodiment, an illumination means, such as a 12 volt incandescent light bulb 60, is mounted on the lower, external edge of the facia 22. A cover shroud 62 is attached to the facia 22 and covers the light bulb 60 to direct light upward from the light bulb 60 through an open end of the cover shroud 62 and over the facia 22. The light enhances the contrast of the flow patterns in the fluid striking the facia 22.

In summary, there has been disclosed a unique fluid display device which is capable of providing a continuous, variable flow pattern in an observable fluid within the chamber for pleasing and aesthetic effects. The flow patterns exhibit turbulence and chaotic flow and generate vortices which are further enhanced when the liquid strikes and deflects off of the angled facia on the liquid chamber. Further variability in the fluid flow patterns is provided by means of user manipulatable motor speed and time switches.

What is claimed is:

1. A fluid display apparatus comprising:

a transparent chamber having a side wall and a bottom wall;

at least one liquid disposed within the transparent chamber and exhibiting visible flow patterns upon movement;

a magnetic member freely movably disposed on the bottom wall of the chamber, the magnetic member having an eccentric shape;

rotatable magnet means, mounted externally from the chamber, for moving the magnetic member on the bottom wall of the chamber through magnetic coupling to create variable flow patterns in the liquid in the chamber; and means, connected to the electric motor, for automatically varying at least one of a direction of rotation of the output shaft of the motor and the speed of rotation of the output shaft between at least two states in a repeating continuous cycle.

2. The fluid display apparatus of claim 1 wherein:

the movable member has an eccentric shape.

3. The fluid display apparatus of claim 1 wherein:

the transparent chamber has a cylindrical shape with a circular cross section.

4. The fluid display apparatus of claim 1 further comprising:

the side wall of the chamber having a top edge, a facia mounted on the top edge and forming a top wall, the facia disposed at an angle to a longitudinal axis of the chamber, and the facia disposed in contact with the liquid in the chamber for deflecting the flow patterns of the liquid in the chamber.

5. The fluid display apparatus of claim 4 wherein:

the facia is disposed at an angle of about 30° to about 60° with respect to the longitudinal axis of the chamber.

6. The fluid display apparatus of claim 4 wherein:

the facia is disposed at an acute angle of about 37.5° to about 45° with respect to the longitudinal axis of the chamber.

7. The fluid display apparatus of claim 4 further comprising:

means, mounted on the chamber, for illuminating the facia.

8. The fluid display apparatus of claim 4 wherein:

the facia is transparent.

9. The fluid display apparatus of claim 4 wherein:

the facia extends from the top edge of the side wall to an opposed portion of the side wall spaced from the bottom wall.

10. The fluid display apparatus of claim 1 wherein:

the magnet is mounted eccentric from a longitudinal axis extending through the transparent chamber.

11. The fluid display apparatus of claim 1 wherein the automatically varying means comprises:

means, connected to the electric motor, for bi-directionally rotating the output shaft of the electric motor.

12. The fluid display apparatus of claim 11 wherein the bi-directional rotating means comprises:

means for reversing the direction of rotation of the output shaft of the electric motor.

13. The fluid display apparatus of claim 11 further comprising:

timer means for providing an output signal at the expiration of each of a plurality of consecutively generated time periods; and means, responsive to the output signal from the timer means and connected to the motor, for reversing the direction of rotation of the output shaft of the motor at the expiration of each time period.

14. The fluid display apparatus of claim 13 wherein the timer means comprises:

timer switch means providing at least two distinct output signals; and means, responsive to the at least two output signals, for varying the time period of the timer means in at least two distinct time periods.

15. The fluid display apparatus of claim 1 wherein the automatically varying means comprises:

the motor being a stepper motor;

a multivibrator providing output signals at one of a plurality of frequencies to continuously step the motor output shaft at one selected frequency of rotational steps; and speed switch means having at least two distinct positions, each position providing an output signal to the multivibrator to select one of the plurality of frequencies.

* * * * *